US005392946A

United States Patent [19]

Holbrook et al.

[11] Patent Number: 5,392,946

[45] Date of Patent: Feb. 28, 1995

[54] LID DESIGN FOR LOW LEVEL WASTE CONTAINER

[75] Inventors: Richard H. Holbrook, Clinton; Wendell E. Keener, Lenior City, both of Tenn.

[73] Assignee: Martin Marietta Energy Systems, Inc., Oak Ridge, Tenn.

[21] Appl. No.: 68,023

[22] Filed: May 28, 1993

[51] Int. Cl.[6] ..... B65D 88/14

[52] U.S. Cl. ..... 220/651; 220/652

[58] Field of Search ..... 220/651, 652, 653

[56] References Cited

U.S. PATENT DOCUMENTS

| | | | |
|---|---|---|---|
| 397,214 | 2/1889 | Atwood | 220/651 |
| 2,115,165 | 4/1938 | Hathorn et al. | 220/651 |
| 5,178,292 | 1/1993 | Korzeniowski | 220/652 |

OTHER PUBLICATIONS

Drawing of a Container From Martin Marietta Energy Systems Inc. p. 1 Apr. 28, 1992.

*Primary Examiner*—Joseph Man-Fu Moy
*Attorney, Agent, or Firm*—Edward A. Pennington; Joseph A. Marasco; Harold W. Adams

[57] ABSTRACT

A container for low level waste includes a shell and a lid. The lid has a frame to which a planar member is welded. The lid frame includes a rectangular outer portion made of square metal tubing, a longitudinal beam extending between axial ends of the rectangular outer portion, and a transverse beam extending between opposite lateral sides of the rectangular outer portion. Two pairs of diagonal braces extend between the longitudinal beam and the four corners of the rectangular outer portion of the frame.

5 Claims, 3 Drawing Sheets

LID DESIGN FOR LOW LEVEL WASTE CONTAINER

This invention was made with Government support under contract DE-AC05-840R21400 awarded by the U.S. Department of Energy to Martin Marietta Energy Systems, Inc. and the Government has certain rights in this invention.

FIELD OF THE INVENTION

The present invention relates generally to containers for low level wastes and, more specifically, to a container having an improved lid design which increases the load carrying capacity of the container. The lid includes a rectangular frame, a longitudinal beam, a lateral beam, and diagonal braces extending between each of the corners of the frame and the longitudinal beam.

BACKGROUND OF THE INVENTION

The U.S. Department of Transportation regulations for shipping hazardous materials are located in the Code of Federal Regulations, Title 49, Parts 100–500. General specifications for "Type A" radioactive material packaging, known as "Specification 7A" (DOT-7A), are in Title 49, Part 178, Section 178.350 (49 C.F.R. S178.350).

A variety of different packaging types have been evaluated by U.S. Department of Energy, Division of Quality Verification and Transportation Safety. For shipping solid materials, these packaging types include steel drums, wooden boxes, fiberboard containers, and steel boxes. Materials shipped may include solid particles of any size, such as sand concrete, debris, soil, etc., and solid objects such as concrete chunks, motors, pumps, etc.

With respect to steel boxes, it is always desirable to increase the load carrying capacity of the container. Yet, it is difficult to effect structural changes to achieve increased strength once the general interior and exterior shape and dimensions of the container have been established. Thus, a need exists to retrofit an existing container design with additional structural features to enhance the strength of the container without substantially changing the general shape and dimensions of the container.

SUMMARY OF THE INVENTION

An object of the present invention is to provide a retrofit of an existing container design with additional structural features to enhance the strength of the container without substantially changing the general shape and dimensions of the container.

Another object of the present invention is to provide an improved lid design capable of enhancing the load carrying capability of a container without substantially changing the general shape and dimensions of the container.

Another object of the present invention is to provide a container lid design which is relatively simple in construction and cost effect to produce.

These and other objects of the invention are met by providing a container for low level waste materials which includes a rectangular shell having a bottom wall and an open top, and a rectangular lid detachably coupled to the shell over the open top, the lid having a planar member, a frame connected to the planar member along a periphery thereof and having four corners, a centered longitudinal beam extending between and connected to opposite axial ends of the frame, a centered lateral beam extending between and connected to opposite sides of the frame and having first and second segments connected to opposite sides of the longitudinal beam, and four diagonal braces respectively connected to the longitudinal beam and the four corners of the frame.

Other objects, advantages and salient features of the invention will become apparent from the following detailed description, which taken in conjunction with the annexed drawings, discloses preferred embodiments of the invention.

DETAILED DESCRIPTION OF THE INVENTION

Figure 1:
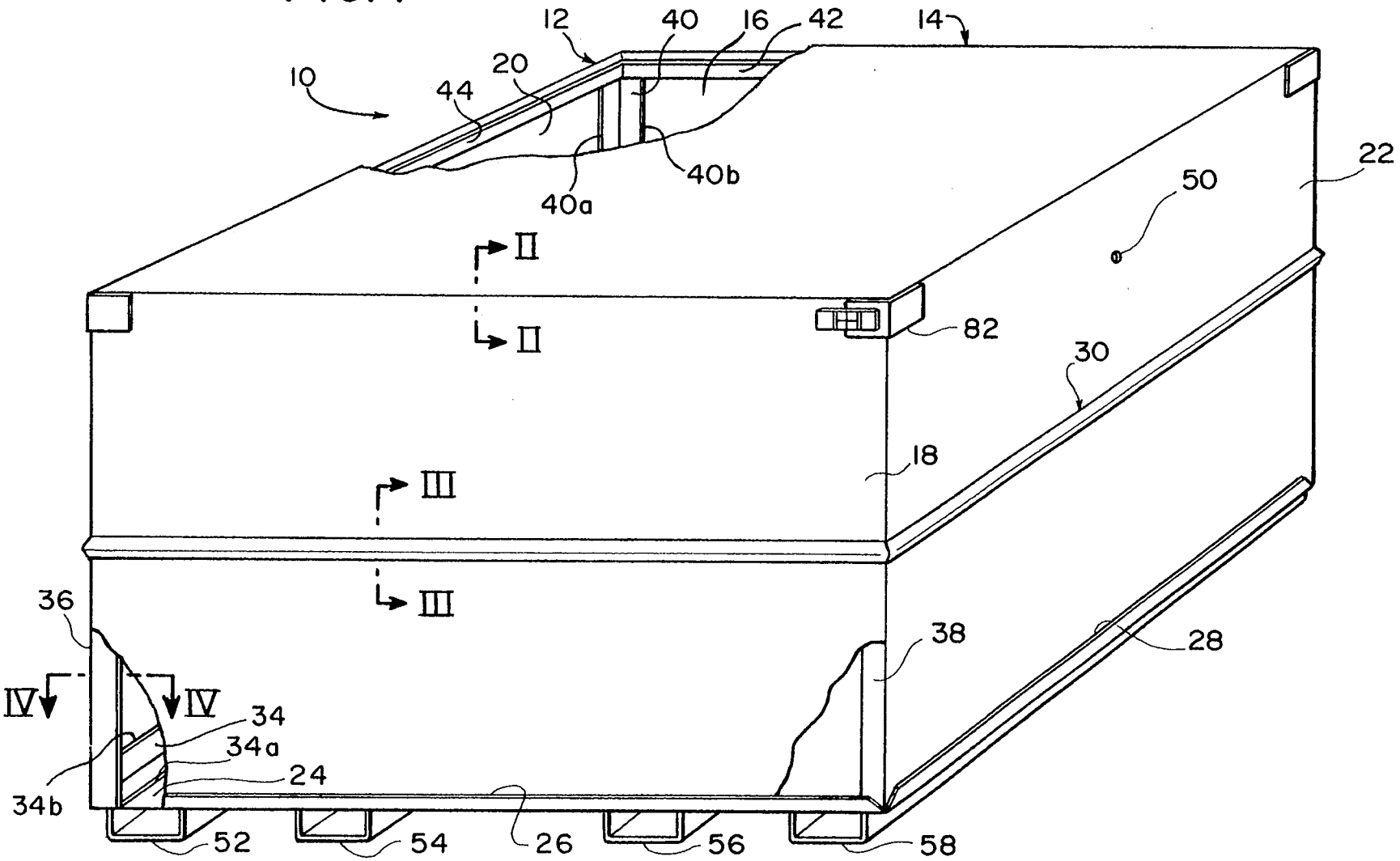
FIG. 1 is a perspective view, partially cut-away, of a container according to a preferred embodiment of the present invention.

Referring to FIGS. 1–5, a container 10 for low level waste materials includes a rectangular shell 12 having an open top and a lid 14 to which the lid 14 is detachably coupled to form an enclosure for the waste materials (not shown). The shell is rectangular and includes two opposite side walls 16, 18, two opposite end walls 20, 22, and a bottom wall 24.

Abutting edges of the side walls 16, 18 and end walls 20, 22 are welded together along a continuous weld line, such as with weld line 26 (FIG. 4) between side wall 18 and end wall 20. All weld lines between the side and end walls are to be fillet in shape and made by MIG welding. Preferably, the side walls 16 and 18 are made from quarter inch thick steel plates, 48 inches by 71.75 inches, bent along the upper edge to form a 0.5 inch flange, such as flange **18*a* (FIG. 2) on side wall 18. After bending, the height dimension becomes 47.5 inches, and after welding together adjacent end and side walls the length dimension becomes 72 inches. The side walls 16 and 18** are preferably made from 11 gauge ASTM A 569 steel.

The end walls 20, 22 are made from quarter inch thick steel plates, 48 inches by 45.75 inches, bent along the upper edge to form a 0.5 inch flange, such as flange **22*a* (FIG. 5) on end wall 22. After bending, the height dimension of the end walls becomes 47.5 inches, and after welding together adjacent end and side walls the length dimension becomes 46 inches. The end walls 20 and 22** are also preferably made from 11 gauge ASTM A 569 steel.

The bottom wall 24 is made from quarter inch thick steel plate, initially 48 inches by 74 inches, which is bent along its lower peripheral edges to form four flanges 26, 28 (only two being shown in FIG. 1). After bending, the height and length dimensions of the bottom wall corresponds to those of the side walls. As with the other walls, the bottom wall is also preferably made from 11 gauge ASTM A 569 steel. Continuous weld lines are formed along the upper edge of each flange 26, 28 to interconnect the respective end and side walls to the flanges.

Figure 3:
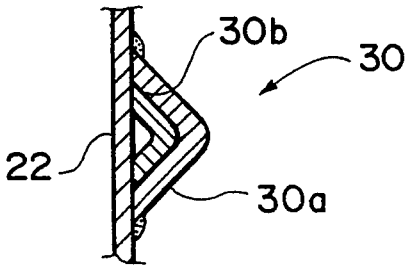
FIG. 3 is an enlarged partial cross-sectional view, taken along line III—III of the container of FIG. 1.

A double thickness reinforcement band 30 is welded to the shell 12 to form a rectangular reinforcing hoop around the shell. As shown in FIG. 3, the band 30 is made in four sections, one corresponding to each of the side and end walls, each section including two nested pieces of two inch by two inch by quarter inch thick angle bar 30*a* and 30*b*. The ends of each section are mitred and welded together to form the continuous band. Upper and lower edges of the outer angle bar 30*a* are welded to the exterior of the respective end and side walls along continuous weld lines formed with a fillet by MIG welding.

Figure 4:
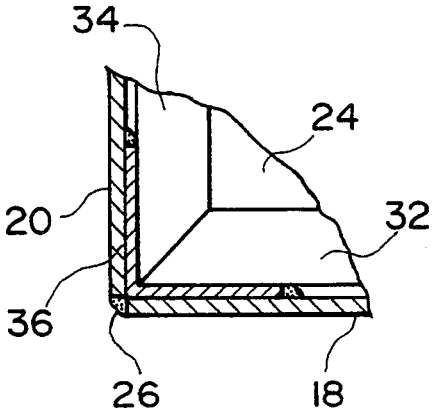
FIG. 4 is an enlarged partial cross-sectional view, taken along line III—III of the container of FIG. 1.
Figure 5:
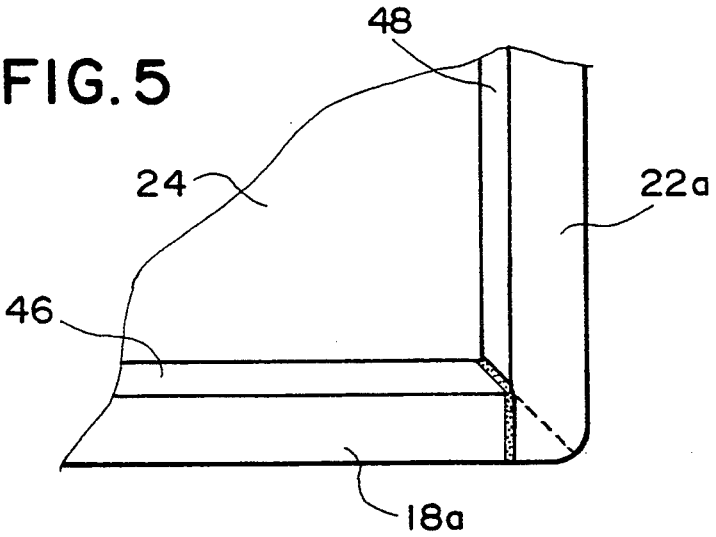
FIG. 5 is an enlarged, partial top plan view of the container of FIG. 1 with the lid removed.

The shell 12 includes a frame structure which includes plural sections of two inch by two inch by quarter inch thick angle bar sections welded together and welded to the respective end and side walls. A lower frame section includes four angle bar pieces 32, 34 (of which only two are shown in FIG. 4) interconnected with adjacent pieces at right angles to each other. Distal edges of each leg of each angle bar piece are welded to each corresponding end and side wall to form continuous weld lines, such as weld lines 34*a* and 34*b* shown in FIG. 1.

The frame further includes four vertical angle bar pieces, of which pieces 36, 38, 40 are shown in FIG. 1, in each of the four corners of the shell 12. Lower ends of each of the four pieces are welded to adjacent angle bar pieces 32, 34 of the lower frame section. Also, the distal edges of each leg of each angle bar piece 36, 38, 40 are welded to each corresponding end and side wall to form continuous weld lines, such as weld lines 40*a* and 40*b* shown in FIG. 1.

An upper frame section is formed by welding together four pieces of square metal tubing 42, 44, 46, and 48, and then welding the upper frame section to the upper ends of the vertical angle bar pieces. Each piece of metal tubing is welded under the flange of each corresponding side and end wall along two continuous weld lines, such as lines 46*a* and 46*b* shown in FIG. 2. TIG welding is preferred over MIG welding in order to eliminate weld splatter in the area where a gasket is to be positioned, as described below. In other areas MIG welding is preferred because it is faster and more productive. The square tubing is preferably 1.5 inches by 1.5 inches by quarter inch wall thickness, and is made of ASTM 501 or A500B steel. The angle bar sections are preferably ASTM A36. The top of the upper frame section also serves as the sealing surface for the gasketed lid when the lid is bolted to the frame.

Optionally, one or more of the side and end walls may be provided with a vent hole 50. The hole 50 may further be fitted with a filter device (not shown). A commercially available filter suitable for installation is sold under the name NUC-FIL-013 VENT, made by NPT Inc., of Golden Colorado (U.S.A.). The filter is a carbon composite. Further options include fork lift attachments 52, 54, 56, and 58 welded to the outer surface of the bottom wall 24. The exact number and location of the attachments may be varied according to need.

When assemble with the lid attached the container 10 has an exterior height of 50.25 inches, width of 46 inches, length of 72 inches and an empty weight of 1,230 pounds vented. Internal dimensions include a height of 47 inches, a width of 45.75 inches, and a length of 71.75 inches. Non-vented weight is 1,230 pounds.

Figure 6:
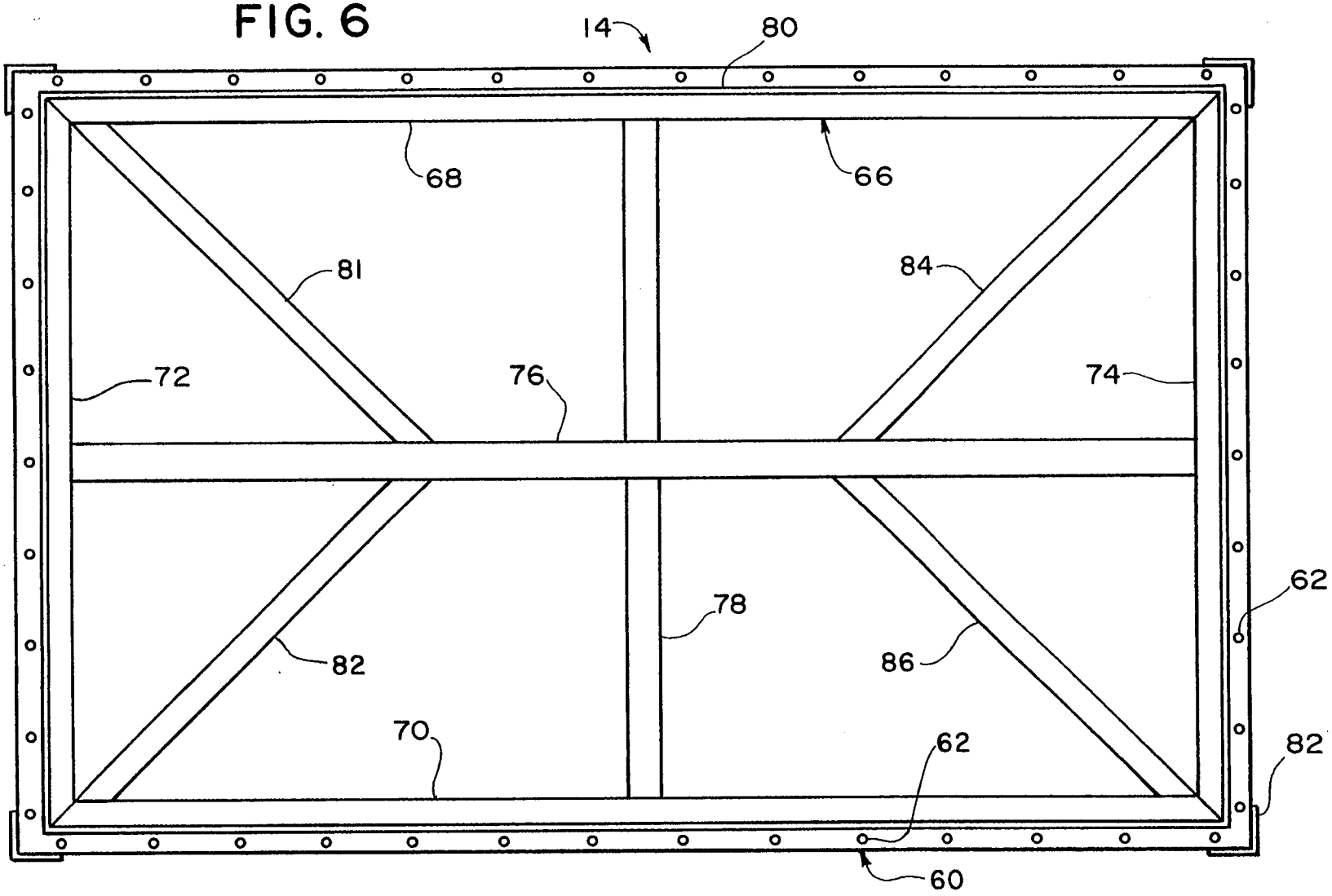
FIG. 6 is an interior plan view of the container lid, removed from the container shell.

Referring now to FIG. 6, the lid 14, shown from the interior side, includes a steel plate 60 having a plurality of equidistantly spaced holes 62 formed in a peripheral edge portion thereof. The holes are aligned with a corresponding number and positioned holes formed in the upper frame portion to permit detachable coupling of the lid 14 to the shell 12 by using threaded fasteners 64 (FIG. 2) or other suitable means.

Figure 2:
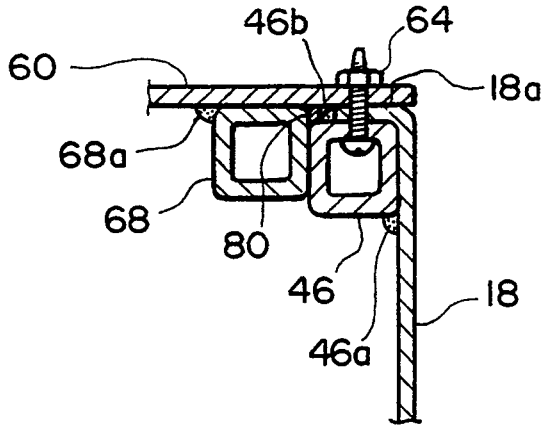
FIG. 2 is an enlarged partial cross-sectional view, taken along line II—II of the container of FIG. 1.

The plate 60 is welded to a rectangular frame 66 made of square tubing sections 68, 70, 72 and 74. Each section is 1.5 inches square (outer dimensions) and quarter inch wall thickness. The sections are mitred at the opposite ends and welded together. The longer sections 68 and 70 are welded to the plate 60 with three inch tack welds, preferably at fifteen inch intervals, on the inside of the frame only. One of the spot welds 68*a* is shown in FIG. 2. The shorter sections 72 and 74 are spot welded to the plate 60 in the same manner at nine inch intervals.

A central beam 76 extends from longitudinally between the two sections 72 and 74. Preferably, the beam 76 is three by five inches, and made of ASTM A-36 steel. Three inch tack welds are applied to both sides of the beam 76 to secure same to the plate 60 at fifteen inch intervals. A transverse or lateral beam 78 is formed in two sections on opposite sides of the beam 76. The opposite ends of each section are welded to the longitudinal beam 76 and two the section 68 and 70 of the frame 66. The sections of the lateral beam 78 are tack welded with three inch tacks at the opposite end junctures, at both longitudinal sides, and also approximately at a medial point between the opposite ends. Two pairs of diagonal braces 80, 82 and 84, 86 extend between and are welded to the central beam 76 and a corner of the rectangular frame 66. Three inch tack welds are applied along opposite sides at the opposite end junctures for each brace. Also, a tack weld is provided at both sides at a medial point between the two opposite axial ends of each.

An elastomeric gasket 80 is adhered to the interior surface of the plate 60 around the outer extent of the rectangular frame so that when the lid 14 is fitted over and on the shell 12 the gasket 80 sealingly engages the upper surface of the upper frame section of the shell, as shown in FIG. 2. Four corner brackets 82 are disposed at each of the four corners of the lid 14 to provide both strength and centering functions.

The combined effect of continuous welding, the use of vertical angle bar supports, as well as a lower angle bar frame portion, coupled with the reinforced lid, has been found to increase the payload of the container 10 from a previous rating of 7,000 to 9,000 pounds without changing the dimensions or overall configuration of the container. Thus, the advantages of increased load-carrying capability are coupled with the advantage of using a design that may have already obtain federal regulatory approval. The increased payload is obtained by increasing the structural integrity of the container which, among other things, provides enhanced resistance to torsional loads.

While advantageous embodiments have been chosen to illustrate the invention, it will be understood by those skilled in the art that various changes and modifications can be made therein without departing from the scope of the invention as defined in the appended claims.

What is claimed is:

1. A container for low level waste materials comprising:

a rectangular shell having an open top;

a rectangular lid detachably coupled to the shell over the open top, the lid including a planar member having an outer surface and an inner surface, and a frame continuously welded to the inner surface of the planar member along a periphery thereof, the frame including a rectangular outer section having four corners, a centered longitudinal beam extending between and connected to opposite sides of the rectangular outer section and opposite sides of the longitudinal beam, and four diagonal braces respectively connected to the longitudinal beam and the four corners of the rectangular outer section of the frame, and a horizontal band continuously welded to an outer surface of the shell, extending completely around the shell, the horizontal band including four sections interconnected at adjacent ends, each section including first and second nested pieces of angle bar welded to the shell along at least two edges of at least an outer one of the two nested pieces of angle bar.

2. A container according to claim 1, wherein the shell includes a frame having a lower rectangular portion, an upper rectangular portion, and four vertical supports interconnecting the upper and lower rectangular portions.

3. A container according to claim 2, wherein the lower rectangular portion of the shell frame includes four horizontally oriented pieces of angle bar welded together at adjacent ends, the upper rectangular portion of the shell frame includes four horizontally oriented pieces of square tube welded together at adjacent ends, and the four vertical supports include four vertically oriented pieces of angle bar welded at lower ends thereof to the lower rectangular portion of the frame and at upper ends thereof to the upper rectangular portion of the shell frame.

4. A container according to claim 3, wherein the shell further includes a bottom wall, two opposite side walls and two opposite end walls, the bottom, end and side walls being welded along two continuous weld lines to corresponding ones of the vertically oriented and horizontally oriented pieces of angle bar.

5. A container according to claim 1, wherein the shell further comprises a bottom wall having an outer surface, and a plurality of fork lift attachments connected to the outer surface of the bottom wall.

* * * * *